US005601655A

United States Patent [19]

Bok et al.

[11] Patent Number: 5,601,655

[45] Date of Patent: Feb. 11, 1997

[54] METHOD OF CLEANING SUBSTRATES

[76] Inventors: Hendrik F. Bok, 52 Thompson St., Fairhaven, Mass. 02719; Philip J. Birbara, 52 Elm St., Windsor Locks, Conn. 06096

[21] Appl. No.: 388,076

[22] Filed: Feb. 14, 1995

[51] Int. Cl.[6] ..... B08B 3/00; B08B 3/04; B08B 3/12

[52] U.S. Cl. ..... 134/1; 134/1.3; 134/902; 134/15

[58] Field of Search ..... 134/1, 10, 26, 134/25.5, 32, 34, 2, 1.3, 15, 36, 902

[56] References Cited

U.S. PATENT DOCUMENTS

| | | | |
|---|---|---|---|
| 4,004,045 | 1/1977 | Stelter | 427/55 |
| 4,187,868 | 2/1980 | Rudolphi | 134/184 |
| 4,370,356 | 1/1983 | Bok | 427/38 |
| 4,696,885 | 9/1987 | Vitan | 430/311 |
| 4,938,257 | 7/1990 | Morris | 134/902 |
| 5,090,432 | 2/1992 | Bran | 134/139 |
| 5,270,079 | 12/1993 | Bok | 427/429 |
| 5,286,657 | 2/1994 | Bran | 437/9 |

FOREIGN PATENT DOCUMENTS 0603008 6/1994 European Pat. Off. .

OTHER PUBLICATIONS

Leenaars et al. "Marangoni Drying: A New Extremely Clean Drying Process" Langmuir 1990, vol. 6, pp. 1701–1703.

"Method & Apparatus for Cleaning Megasonics" EP Publication No. 0603008A1, Jun. 22, 1994.

*Primary Examiner*—Jill Warden
*Assistant Examiner*—Alexander Markoff
*Attorney, Agent, or Firm*—David H. Semmes

[57] ABSTRACT

Method for cleaning substrates, particularly a method for removing soluble contaminants and particulate materials from the substrate surface. According to the method, a substrate is inverted and moved horizontally, while flowing cleaning fluid inclinedly upwardly towards the substrate and oppositely to the moving of the substrate; accoustically vibrating the cleaning fluid and, elevating the flowing cleaning fluid at a point adjacent the substrate surface, such that that the flowing cleaning fluid contacts the substrate surface and forms leading edge and trailing edge menisci between the flowing cleaning fluid and the moving substrate.

9 Claims, 6 Drawing Sheets

METHOD OF CLEANING SUBSTRATES

CROSS-REFERENCES TO RELATED APPLICATIONS

None.

BACKGROUND OF THE INVENTION

1. Field of the Invention

The present invention relates to the cleaning of objects, particularly substrates such as flat optic and flat panel display surfaces. More specifically, the present invention relates to methods and an apparatus for cleaning flat or curved planar surfaces by utilizing aqueous based cleaning solutions, deionized (D.I.) water rinsing and a drying process which take place sequentially as the surface to be cleaned is moved in a direction oppositely to the flowing fluid which performs these functions. Contaminant removal and rinsing are effected by flowing liquids, oppositely to the moving substrate, acoustical scrubbing and inducing surface tension film drainage forces oppositely to the moving flat or curved planar surfaces to be cleaned. The suggested modular in-line units performing these processes are of compact configuration and can be integrated, so as to enable cleaning to be adaptable to applications where continuous and in-line usage is desirable.

2. Description of the Prior Art

STELTER 4,004,045

BOK 4,370,356

VIJAN 4,696,885

BOK 5,270,079

LEENAARS et al. "MARANGONI DRYING: A NEW EXTREMELY CLEAN DRYING PROCESS"; *Langmuir* 1990, vol. 6, pp 1701–1703. "Method and Apparatus for Cleaning by Megasonics", EP Publication No. 0 603 008 A1, Jun. 22, 1994.

In the fabrication of flat display panels, continued miniaturization of pattern dimensions with the resultant increase in pattern densities, and the increase in panel sizes are occurring at a rapid pace and will continue, as quickly as improved technologies are developed. It is well documented that the trend to smaller feature sizes is significantly more sensitive to the population of submicron and micron-sized particulate materials and both organic and inorganic contaminant films. Unfortunately, these smaller particle sizes are extremely difficult to remove from surfaces due to the strong adhesive bonds, including van der Waals forces, that tenaciously hold these small particulate materials to the surface of the panel.

Almost all aspects of flat panel display processing steps which include handling, processing, diagnostic measuring and storage are potential sources of contamination. Such contamination may consist of particulate materials, organic materials, metallic impurities, inorganic salts and native oxides, as well as absorbed gaseous and liquid molecules. Aqueous based cleaning agents are necessary to remove several contaminant challenges and are desirable due to governmental regulatory concerns associated with organic based solvents. Cost effective and improved cleansing processing equipment capable of dislodging and removing these several categories of contaminants is desired in order to meet the higher performance standards for flat panel fabrication processes. The use of aqueous cleaning and dionized water rinsing liquids provide important advantages in reducing aqueous fluid consumption and waste water effluent quantities.

Present wet process cleaning methods are most often batch processes which involve the immersing of objects within a bath of cleaning fluid and exposing the object to ultrasonic and megasonic acoustical pressure waves in order to dislodge and remove particulate materials and, also, to accelerate the dissolution rate of organic and inorganic contaminant films. Ultrasonic transducers vibrating at frequencies between about 10 to 80 KHz are effective for particles larger than 1 micron. Megasonic transducers vibrate at higher frequencies ranging for 0.8 to 6 MHz and are useful in penetrating the surface/liquid interfacial boundary layers to dislodge particles smaller than 1 micron. The operation of ultrasonic and megasonic cleaning systems within a batch processor requires additional handling when integrated within an in-line continuous processing system. This additional handling increases the likelihood of contaminant reattachment to clean surfaces.

Aqueous cleaning and subsequent dionized rinsing of surfaces to be cleaned in a batch process mode entail a relatively high fluid usage and, as a consequence, proportionately high waste generation volumes. Accordingly, most batch cleaning systems stack the panel surfaces in a parallel arrangement. As a result, the removal of surface contaminants in the region between the passages of the closely stacked surfaces requires substantial fluid recirculation, in addition to considerable liquid makeup volumes to prevent the redepositing of dissolved and suspended impurities.

One particularly useful method for cleaning flat panels is described in EP 0 603 008 which addresses the removal of submicron-sized particulate materials and other soluble contaminants. Therein the utilization of megasonic pressure waves causes the upper surface of liquid to rise as a weir above the upper ends of a reservoir, while contacting the substrate surface to be cleaned from below. The cleaning liquid fluid then flows over a weir into a second reservoir. In EP 0 603 008, the megasonic pressure waves are directed perpendicularly. Consequently, both cleaning liquid flow and acoustical vibrations are directed nearly equally towards both the leading edge and trailing edge weirs. As a result, the contaminants removed from the surface to be cleaned and those present within the contacting flowing fluid are uniformly concentrated in effluent flows over the leading and trailing edge weir surfaces. The trailing edge effluent flow which moves in the same direction as the surface to be cleaned serves to inhibit adhering film drainage from hydrophobic surfaces. This relative movement of the surface to be cleaned and the flowing of cleaning liquid contributes to increased adhering film thicknesses with a consequent increase in residual film drying time, as well as an increase in contaminant residue levels which are deposited after the evaporation of the rinse aqueous film. Furthermore, the teachings of EP 0 603 008 do not address the removal of contaminants of greater size than 1 micron and do not suggest the concept of integrating fluid cleaning, dionized water rinsing and drying processes within a sequential and compact configuration suitable for in-line process adaptability.

Accordingly, methods and apparatus are desired for cleaning flat or curved planar surfaces to remove micron and submicron-sized particulate materials, while solubilizing inorganic and organic contaminants.

Methods and apparatus are desired that promote the nearly complete drainage of rinsing liquids from the surface to be cleaned, so as to accelerate drying rates and enhance cleanliness levels by minimizing the deposition of contaminant residues dissolved in rinse water films.

Methods and apparatus are desired for the integration of the cleaning, rinsing and drying operations within a sequential and compact configuration that can be readily adapted to in-line deployment in the several processing steps involved in the fabrication of flat optic and panel display surfaces.

In addition, methods and apparatus which provide high levels of surface cleanliness, while substantially diminishing the requirements for aqueous cleaning liquid and dionized water usage and, consequent, waste water effluent quantities are desired to reduce processing costs.

SUMMARY OF THE INVENTION

In accordance with the present invention, methods and apparatus are provided for removing soluble contaminants and particulate materials, both micron and submicron sizes, from flat or curved planar surfaces. The present invention permits the cleaning, deionized water rinsing and drying processes to take place virtually simultaneously within an integrated, sequential and compact mode, as the surface to be cleaned is moved relatively to each of the units performing these functions. The surface of the object to be cleaned is oriented in a face down position and is contacted from below by the cleaning and/or rinsing liquids, such that surface tension forces between the surface and liquid form an interfacial contact area bounded by the leading and trailing edge menisci of cleaning liquid.

The cleaning and rinsing liquids may be contained within separate modular applicator units. Each modular unit contains a dual chambered structure such that liquids introduced to the first chamber contact the surface to be cleaned from below, then flow over a downstream weir into a second chamber. The opposite side walls of the first chamber are inclined toward a leading edge of the liquid meniscus so as to guide the liquid movement in a direction toward the leading edge meniscus and oppositely to the movement of the surface to be cleaned.

Sequentially, the liquid flows over a slotted tube attached to a downstream inclined side wall of the first chamber which tube defines the top surface of a weir. The slot is oriented upwardly at a slight angle from the perpendicular to the surface so as to discharge liquid inclinedly onto the substrate surface and over the weir. Trailing edge liquid dispensed from this slot slightly elevates the liquid flowing toward the leading edge meniscus, so as to facilitate liquid contact with the surface to be cleaned.

Ultrasonic cavitating vibrations are introduced to the flowing cleaning liquid within a first cleaning modular unit in a direction parallel to the inclined weir wall. Similarly, megasonic pressure waves may be introduced to a second cleaning and rinsing modular unit. The megasonic pressure waves result in surface shearing forces at the liquid/surface to be cleaned interface, which shearing forces oppose the relative movement of the surface being cleaned. Both ultrasonic and megasonic pressure waves accelerate dissolving of soluble contaminants and removal of particulate materials. The megasonically induced shearing forces which oppose the movement of the surface being cleaned also enhance the drainage of aqueous films adhering to the hydrophilic surface being cleaned upstream of the trailing edge meniscus.

A water soluble organic vapor is directed at the rinsing liquid film attached to the hydrophilic surface slightly downstream of the trailing edge rinse water meniscus. The organic vapor thusly absorbed into the film reduces the surface tension of the film relative to the bulk rinsing liquid. The resulting surface tension gradient causes the adhering water film to drain back into the bulk flow of the rinsing liquid. Consequently, contaminants present within the drained film are returned to the bulk flow of the cleaning liquid. This more complete film drainage effects a higher level of surface cleanliness and, also, significantly increases the surface drying rate.

The processing operations may be performed by two cleaning units, one rinsing unit and one drying unit. The common cleaning and rinsing processing steps within each of the suggested modular units may include:

a. flowing cleaning liquid in an upward and inclined direction within a first chamber to contact the surface to be cleaned and provide a uniform flow of liquid over a downstream weir into a second chamber;

b. introducing acoustic vibrations within the flowing cleaning liquid in a direction parallel to the flowing liquid within the first chamber;

c. directing a limited flow of cleaning liquid upwardly over the weir, so as to effect a slight elevation of the flowing liquid;

d. moving the surface of the object to be cleaned in an essentially horizontal orientation and in a direction that is opposite to the flowing cleaning liquid within the first chamber;

e. establishing contact and wetting of the surface of the object to be cleaned, flowing cleaning liquid over the weir, in slight elevation such that leading edge and trailing edge menisci are formed between the top surface of the flowing cleaning liquid and the surface of the object to be cleaned within the first chamber.

The processing may include absorption of a soluble organic vapor within a flowing rinse liquid downstream of the trailing edge meniscus so as to effect a cleaning liquid surface to be cleaned surface tension gradient that results in a more complete drainage of adhering rinse liquid film into the bulk of flowing rinse liquid, which contributes to the drainage of solubilized contaminants and facilitates drying.

In another aspect of the present invention, an apparatus is provided for cleaning flat or curved planar surfaces of an object. The suggested apparatus may consist of sequential modular units performing cleaning, rinsing and drying functions. The structural components of the cleaning and rinsing modular units include:

a. a first chamber with an open top and a closed bottom which is perpendicular to a first inclined wall having a horizontal top edge attached to a slotted tube defining a lateral slot facing upwardly and slightly offset in the direction of the first inclined wall such that the horizontal top edge serves as a weir;

b. a second chamber adjacent the first chamber including a closed bottom and open top which is lower than the first chamber top, such that cleaning and rinsing liquids flowing over the weir of the first chamber are collected within the second chamber; and c. an acoustic transducer, either ultrasonic or megasonic, which is attached to the inclined first wall of the first chamber, such that vibrations generated by the transducer are emitted in a direction parallel to the inclined first wall.

The suggested apparatus contributing to rinse liquid film drainage consists of a laterally extending tube with a narrow slit. The tube is situated perpendicularly to and in close proximity to the flat surface of the object being cleaned. A concentric gaseous sparger tube within the tube and running the length of the slit effects controlled evaporation of a water soluble organic liquid, such that effluent gas containing the organic vapor impinges upon the rinse film downstream of the trailing edge meniscus. The absorption of the organic vapor within the aqueous rinse film establishes a surface tension gradient which enhances surface film drainage rates, cleanliness levels and surface drying rates.

By virtue of the practices of the present invention, suggested high cleanliness standards required for the processing steps involved in the fabrication of flat optic and flat panel display surfaces are met while substantially reducing cleaning fluid and rinsing water usage and consequent waste cleaning and rinsing fluid effluent quantities.

DETAILED DESCRIPTION OF THE INVENTION

Although the configuration of objects being cleaned is not critical to the present invention, the methods and apparatus of the present invention are especially suited for flat or curved planar surfaces, such as substrates. Such surfaces include, but are not limited to, flat panel displays as are utilized in instrumentation and associating panels, lap top computers; optical devices such as mirrors and lenses; semiconductor devices such as silicon and germanium wafers, and the like. Materials to be cleaned include glass, metals, ceramics, plastics and combinations thereof.

The methods and apparatus of the present invention are particularly suited for a production oriented cleansing system which addresses the removal of several categories of contaminants in order to achieve the cleanliness levels required for the increasingly complex pattern and panel size dimensions. The contaminants removed include particulate matter of both micron and submicron size, organic matter, inorganic slats and native oxides, and absorbed gases and liquid molecules.

Due primarily to regulatory concerns, aqueous based cleansing liquids are preferred for use. However, organic solvents may be satisfactorily utilized to remove the several types of the previously mentioned contaminant categories. Metal, dielectric and photo resist film residue removal are solubilized or lifted from the surface by use of aqueous based chemical solutions. For example, the trademarked product RCA-1, which consist of an aqueous solution of ammonium hydroxide and hydrogen peroxide, is effective for the removal of particulate materials and organic matter. The trademarked product RCA-2, which consists of an aqueous solution of hydrochloric acid and hydrogen peroxide, facilitates the removal of metals and ions. The choice and usage of cleaning liquids can be varied and optimized to handle specific contaminant removal challenges.

The invention is further described with reference to the attached drawings. Those skilled in the art will recognize that the drawings are presented in a simplified or schematic form that does not illustrate various elements which are known to those skilled in the art, as for example, valves, switches, process control devices, heating elements, wiring, tubing, and the like.

Figure 1:
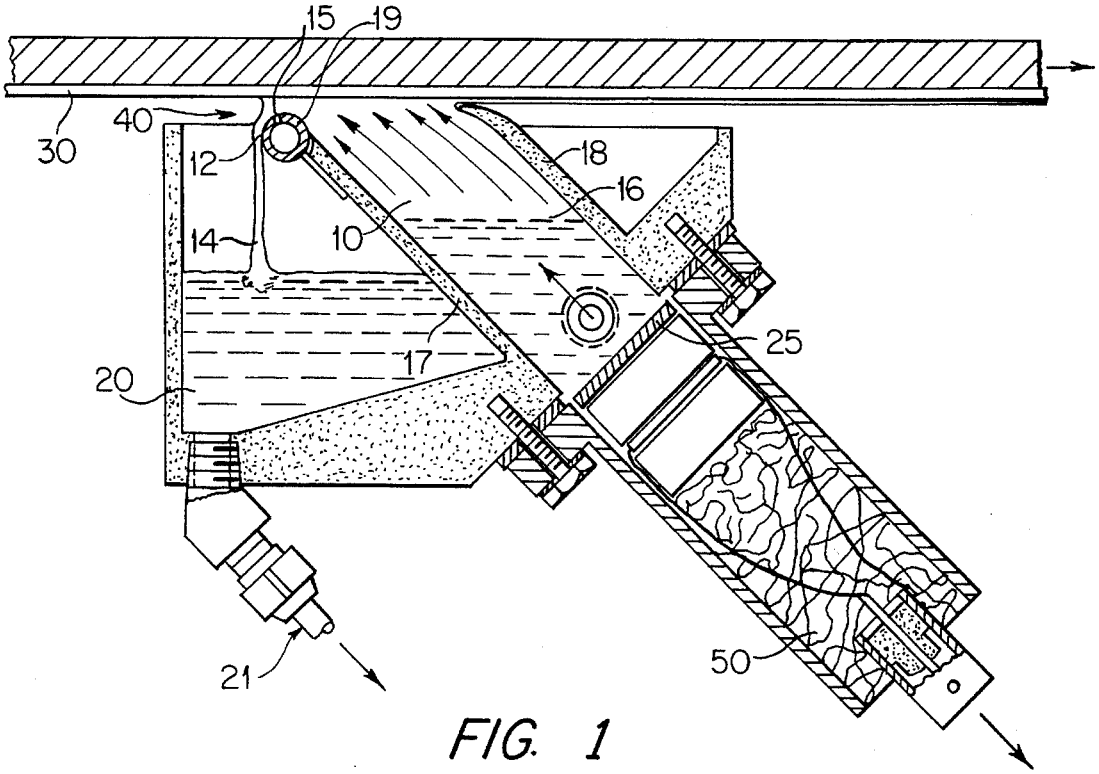
FIG. 1 is a fragmentary vertical section of a cleaning liquid unit wherein the flowing cleaning liquid flows upwardly against the moving surface 30 and in an inclined direction opposing the movement of substrate 30.
Figure 2:
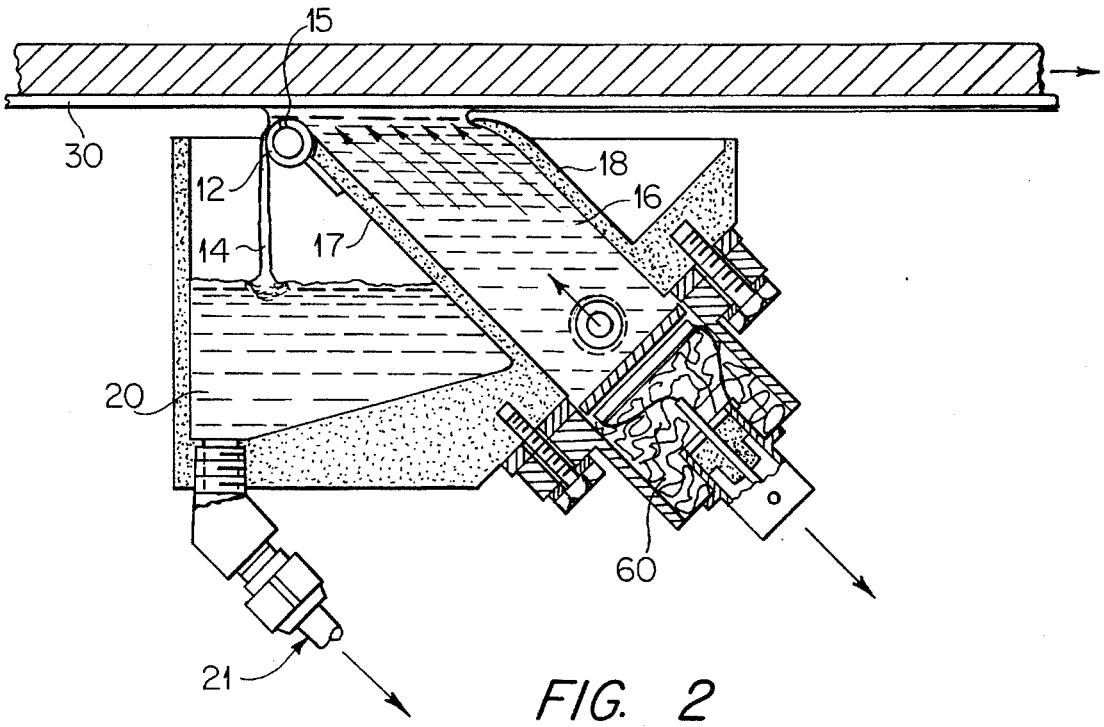
FIG. 2 is a similar fragmentary vertical sectional view of a cleaning liquid unit similar to FIG. 1.
Figure 3:
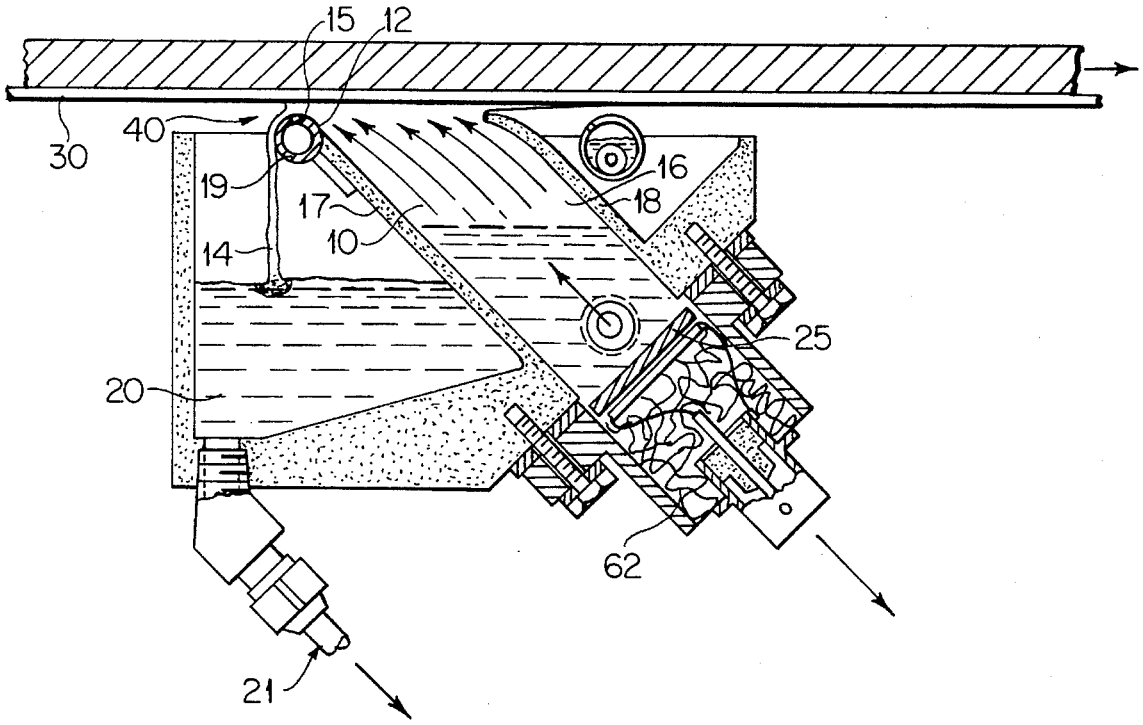
FIG. 3 is a fragmentary vertical sectional view of a rinsing liquid module wherein the rinsing liquid is directed towards the inverted substrate surface 30 at an inclined acute angle.

In accordance with the present invention, FIGS. 1, 2 and 3 illustrate methods for initial cleaning, secondary cleaning and rinsing processes, respectively. The two cleaning and rinsing modules include first liquid chamber 10 and second liquid chamber 20. First or upper chamber 10, contains weir 12. Second or lower chamber 20 receives effluent cleaning and rinsing liquid 14 from first chamber 10. In practice, liquid 16 introduced into first chamber 10 contacts the inverted surface 30 to be cleaned or rinsed, then flows over downstream weir surface 12 thereby creating a weir effect, and thence into second chamber 20. The first wall 17 of first chamber 10 abuts weir edge 15 and is inclined towards liquid trailing edge meniscus 40 formed by the movement of the flat panel surface 30 in a direction which opposes the flow of liquid movement over weir 12. Likewise, upper wall 18 of the first chamber 10 opposite to weir lower wall 17 is, also, inclined towards leading edge meniscus 40; however, the inclined pitch need not be as pronounced as the weir or leading edge side. This upper wall 18 is approximately 1 millimeter to about 3 millimeters higher than the opposing lower wall 17. This vertical height differential and the pitch of the inclined walls serves to guide liquid movement entering first chamber 10 in a direction that overflows weir surface 12 and opposes the movement of the surface 30 of the object to be cleaned. As illustrated in FIG. 3, cleaning liquid 16 flows over slotted tube 19 attached to the downstream or lower wall 17 which with the surface of the top slotted tube 19 surface defines weir 12. Cleaning liquid injected from slot 15 lifts the inclined stream of cleaning 16 liquid flowing towards the leading edge meniscus, so as to enhance the weir effect and facilitate interfacial contact between cleaning liquid 16 and surface 30. Typically, the distance between the upper flowing surface of cleaning liquid within the first chamber and the flat surface of the object to be cleaned is about 4 to about 6 millimeters, such that flowing of liquid is maintained over the weir surface 12.

As illustrated in the initial cleaning module illustrated in FIG. 1, an ultrasonic transducer 50 may be attached to a line 25 forming a bottom of first chamber 10 which is perpendicular to the lower wall 17. Ultrasonic cavitating vibrations, preferably having a vibrational frequency from about 20 KHz to about 80 KHz, are introduced to the volume of flowing cleaning liquid in a direction parallel to the inclined lower wall 17. The cavitating vibrations enhance the solubility of contaminants and are effective in dislodging particulate materials from about 1 micron and larger.

As noted in the secondary and tertiary cleaning and rinsing modules illustrated in FIGS. 2 and 3, respectively, megasonic transducers 60 and 62 are attached to the bottoms of the first chamber 10 so as to be perpendicular to inclined lower wall 17. Megasonic pressure waves, from 800 KHz to about 6 MHz and preferably from 1 to 2 MHz, are effective in removing particulate materials of about 1 micron and less. Such megasonic vibrations raise the level of cleaning liquid in the first or upper chamber 10 from about 1 to 5 millimeters, which results in cleaning liquid spilling over weir 12 and into the second chamber 20 which collects the overflow.

Manifestly, the surface 30 of the object to be cleaned and flowing of cleaning and rinsing liquids or both may be moved in opposing directions. Typical rates of relative movement are from about 1 cm per minute to about 250 cm per minute. Flowing cleaning liquid entering second chamber 20 is withdrawn via line 21 and recirculated by a suitable pump and filter, not illustrated. The filter removes particulate materials entering the flowing liquid from the surface of the object, the environment and system components and is preferably sized to remove 99% of particulate materials greater than 0.1 microns. The unit's cleaning liquid volume is not critical to the process but typically ranges from 0.1 liters to about 10 liters. The liquid circulation rates generally vary from about 0.01 volumes of fluid per minute to about 1 volume of liquid per minute.

The temperature of the flowing cleaning liquid may be controlled conventionally by heating or cooling of the fluid supply. Temperatures should preferably be less than the cleaning liquid boiling point. Typical operating temperatures range from about 70° F. to about 175° F. Elevated operating temperatures result in an increase in contaminant solution and an increase in the drying rate of deposited film. It may be anticipated that the introduction of acoustic energy to the flowing cleaning liquid in the first chamber results in increasing the liquid temperature. Temperature rises of about 5° F. to about 20° F. are typical with actual temperature rises being determined by the liquid flow rate, ambient temperatures and other system and component operating characteristics. The cleaning process is intended to take place at ambient pressure conditions; however, operating under vacuum and/or pressurized conditions is possible and, perhaps, desirable if contaminant of vapors or the exclusion of surrounding environmental contaminants is appropriate.

Figure 4:
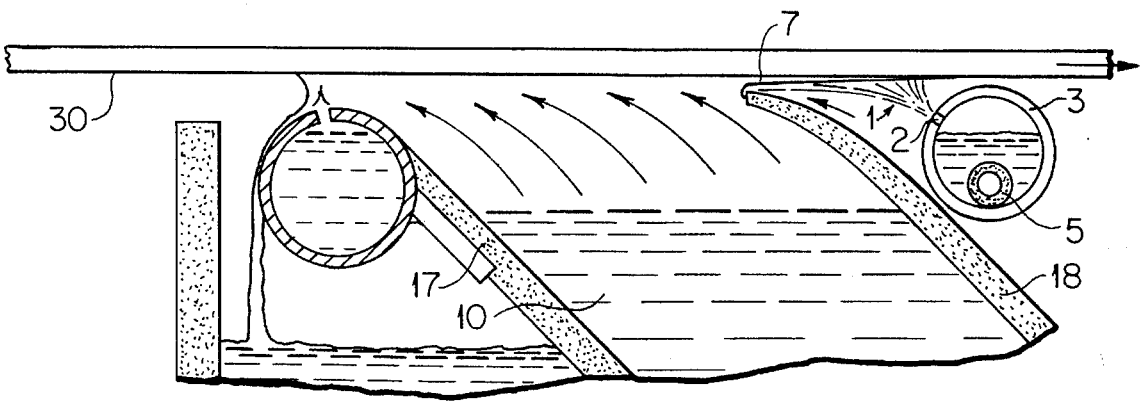
FIG. 4 is a fragmentary vertical section of a drying module wherein aqueous soluble organic vapor is directed downstream of the trailing edge of the flowing cleaning liquid meniscus resulting in surface tension gradient forces that enhance film drainage from substrate surface 30 into the bulk of flowing cleaning liquid.

FIG. 4 illustrates the operation of the surface tension gradient drying method utilized with the present invention. A small flow of water soluble organic vapor 1 is dispensed from thin slit 2 in tube 3 that is attached to inclined upper wall 18 of rinse liquid first chamber 10 which upper wall 18 is opposite to the weir lower side wall 17. Tube 3 is parallel to and in close proximity to substrate surface 30 of the object being cleaned and the rinsing liquid film 7 adheres to surface 30 immediately downstream of the trailing edge meniscus. The organic vapor which is absorbed into thin film 7 reduces the surface tension of film 7 relative to the bulk of rinsing liquid 10. The resulting surface tension gradient causes the film of the adhering rinse liquid to drain rearwardly or oppositely to the moving surface 30 and into the bulk of the rinsing liquid 10. This rearward rinsing liquid film drainage results in the film's dissolved impurities and microscopic sized particulate materials flowing back into bulk liquid 10. The rearward rinsing film drainage, also, contributes to rapid drying of surface 30 within a short distance from the trailing edge meniscus. The arrows shown in FIG. 4 depict the lateral film drainage flow path which opposes the movement of the inverted surface.

Figure 5:
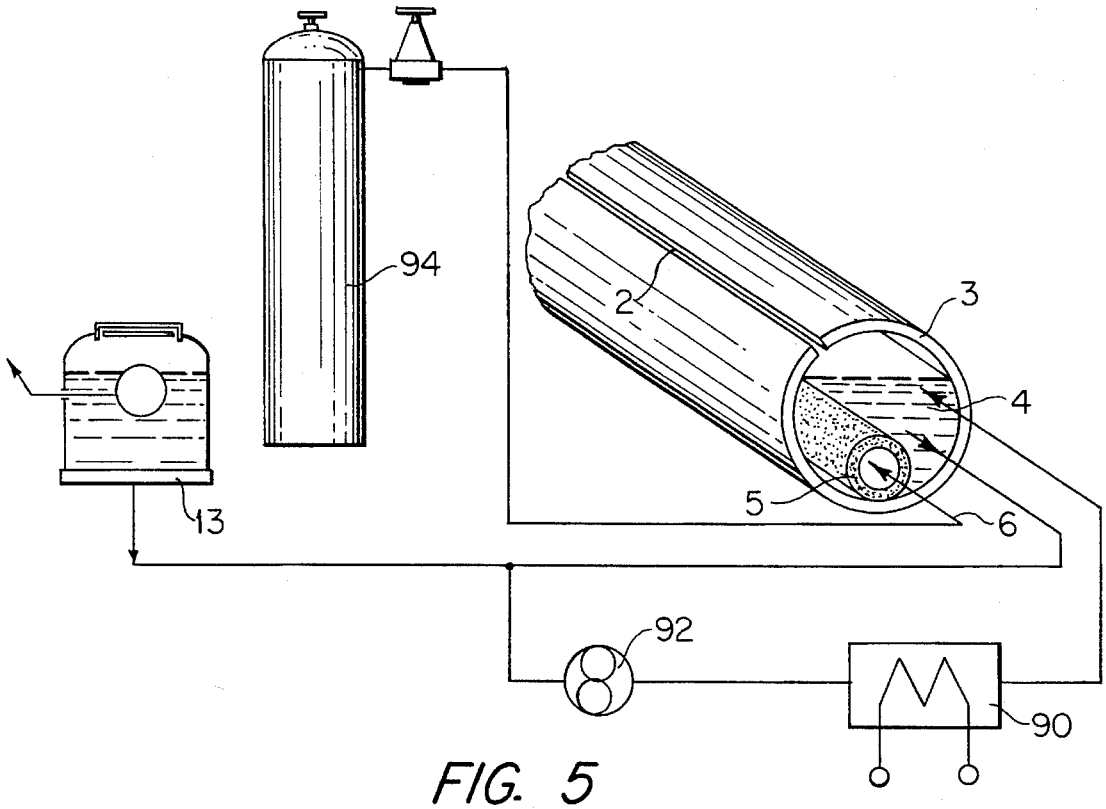
FIG. 5 is an enlarged schematic view of a water soluble organic vapor tubular dispensing element, as illustrated in FIG. 4.

FIG. 5 illustrates the organic vapor dispensing element 3 for effecting the aforesaid surface tension gradient drying. Tube 3 with elongated slot 2 receives water soluble organic liquid 4 from storage source 13. Positioned within tube 3 is a porous sparger tube 5 which permits gas 6 to permeate organic liquid. The gaseous flow exiting from the lateral slot 2 which contains the evaporated organic vapor 4 is directed to the rinse liquid film immediately downstream of the trailing edge meniscus. Organic liquid 4 evaporation rate is primarily dependent upon the gas 6 flow rate and the vapor pressure of organic liquid 4. The vapor pressure may be increased by elevating the temperature of organic liquid 4 by transferring heat to the organic liquid 4 via heated water exchangers or other means. Sparger tube 5 is preferably a porous tube which serves to filter the gas of particulate materials prior to contact with the organic liquid 4. Pump 92 recirculates organic liquid 4 through a heating or cooling unit 90 to regulate the vapor pressure of organic liquid 4. Preferred organic liquids include low molecular weight and volatile organics, such as alcohol, including ethanol, isopropanol and butanol. These relatively volatile alcohols result in appreciable surface tension reductions even for concentrations of less than 1 wt %. Thus, for a relatively large rinse water film, for example, 100 microns, the quantity of alcohol liquid usage is relatively insignificant; i.e., less than 0.01 $cm^3$ of ethanol per 100 $cm^2$ of surface area. The flowing rinse liquid in the first chamber 10 of the rinse water modular unit illustrated in FIG. 4 is thus more than sufficient to ensure that the dissolved organic liquid 4 concentration does not accumulate at the trailing edge meniscus. In addition, the flowing of rinse liquid oppositely to movement of surface 30, as well as megasonic pressure wave forces in concert with the induced surface tension gradient forces contribute to facilitating the rinse liquid film draining. When applied after cleaning and rinsing, the surface tension gradient drying significantly contributes to providing high cleanliness levels for high-throughput processing of large flat panel surfaces, such as flat panel display, microelectronic and optics applications.

Figure 6:
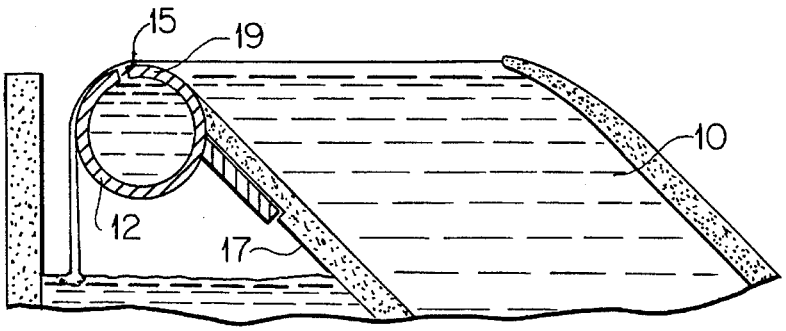
FIG. 6 is a fragmentary vertical section view of flowing cleaning liquid over the weir surface prior to forming an elevated fluid wave to initiate fluid contact with the inverted surface.
Figure 9:
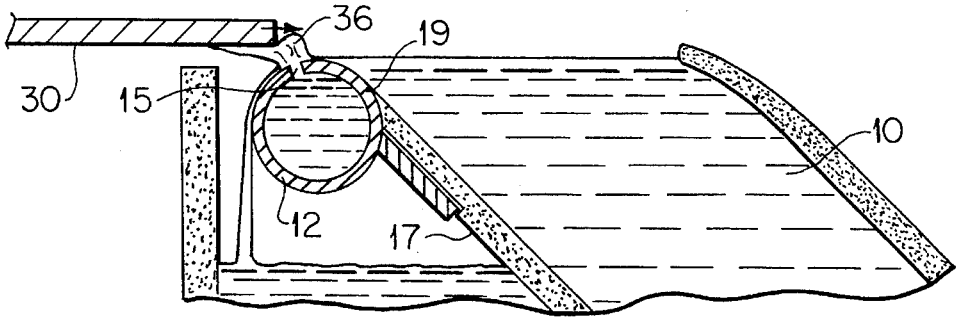
FIG. 9 is a fragmentary vertical section of the weir construction illustrated in FIG. 6 and illustrating overflow and elevating wave 36 prior to making contact with the substrate 30.
Figure 10:
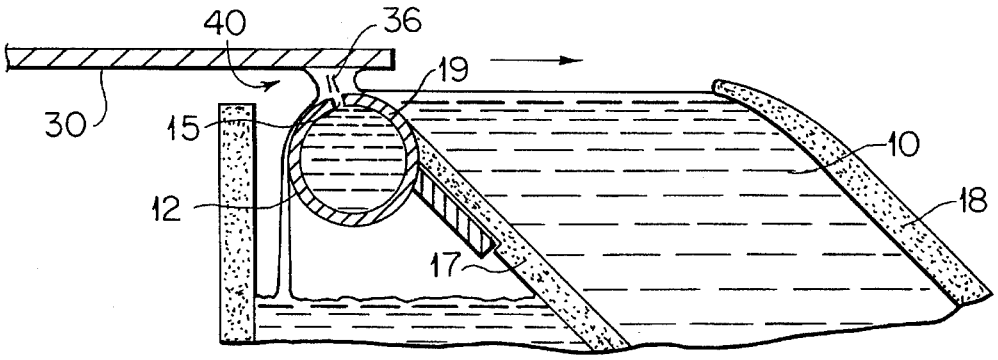
FIG. 10 is a fragmentary vertical section of the weir device illustrated in FIGS. 6 and 9 and showing wave 36 making contact with the inverted substrate 30 surface forming two leading edge meniscus 40, 41 defining a small wetted area.
Figure 11:
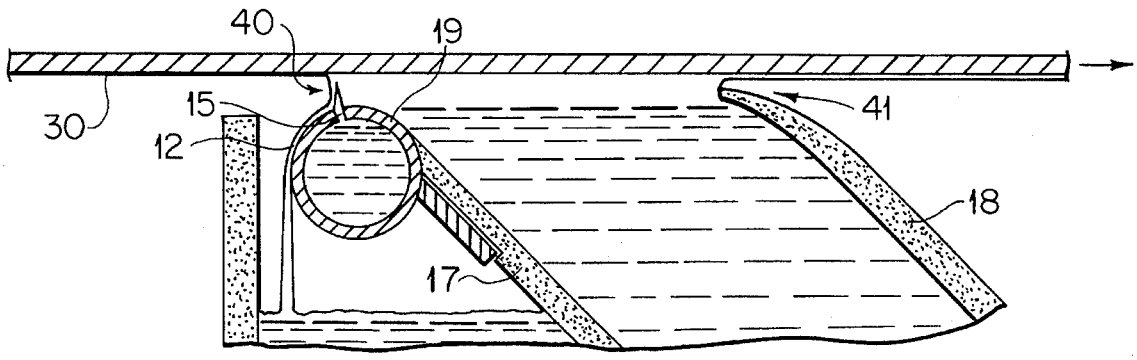
FIG. 11 is a fragmentary vertical section as in FIG. 10, showing the flowing cleaning liquid forming leading edge meniscus 40 and trailing edge meniscus 41 defining a wetted area on the substrate surface and extending downwardly over the side wall of weir 12.

FIGS. 6 and 9–11 illustrate the method of establishing a meniscus 40 between the top surface of liquid 10 flowing over weir 12 of the first chamber of a cleaning or rinsing module with respect to inverted surface 30 of the object being cleaned. Liquid 10 flows over slotted tube 19 attached to downstream inclined wall 17 which abuts tube 19 to define the top surface of the weir 12. Elongated slot 15 in tube 19 is oriented in an upward direction and slightly offset from the perpendicular, so as to discharge liquid inclinedly towards surface 30 to be cleaned and over weir 12. As illustrated in FIG. 9, liquid dispensed from slot 115 provides a lift to the flowing liquid in the form of wave 36 in order to establish liquid contact with the surface 30 to be cleaned. FIG. 6 shows the first chamber of a cleaning or rinsing module prior to establishing an elevated wave 36 as a result of flowing liquid through offset slot 15. FIG. 10 illustrates the contact of the upper surface of wave 36 with the inverted surface 30 to be cleaned, as surface 30 is advanced in a direction opposing the flowing liquid. FIG. 11 shows the wetting of surface 30 and the establishing of menisci 40, 41 between the inclined walls 17 and 18 of the first chamber of the cleaning and rinsing modules.

Figure 12:
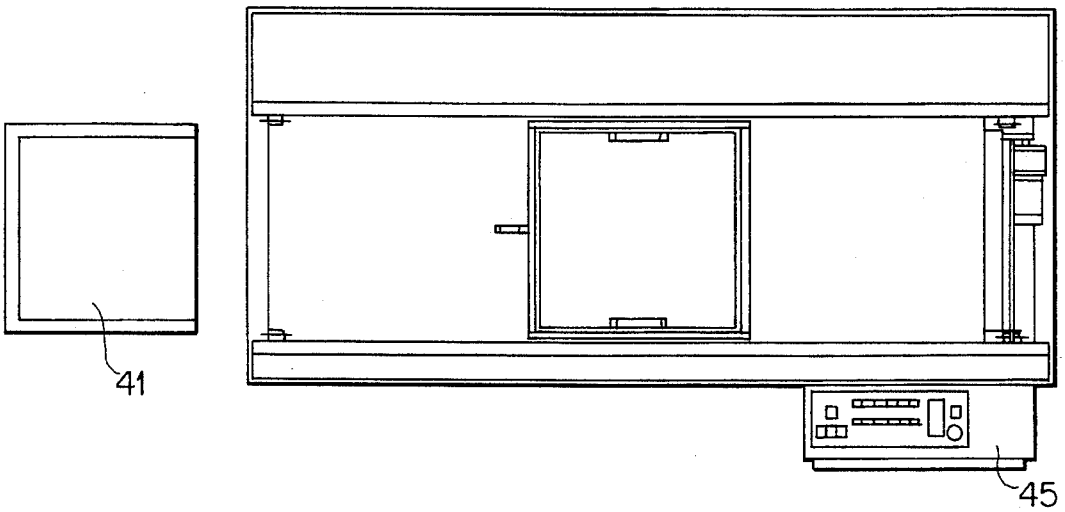
FIG. 12 is a top plan of the cleaning process module illustrated in FIG. 7.
Figure 7:
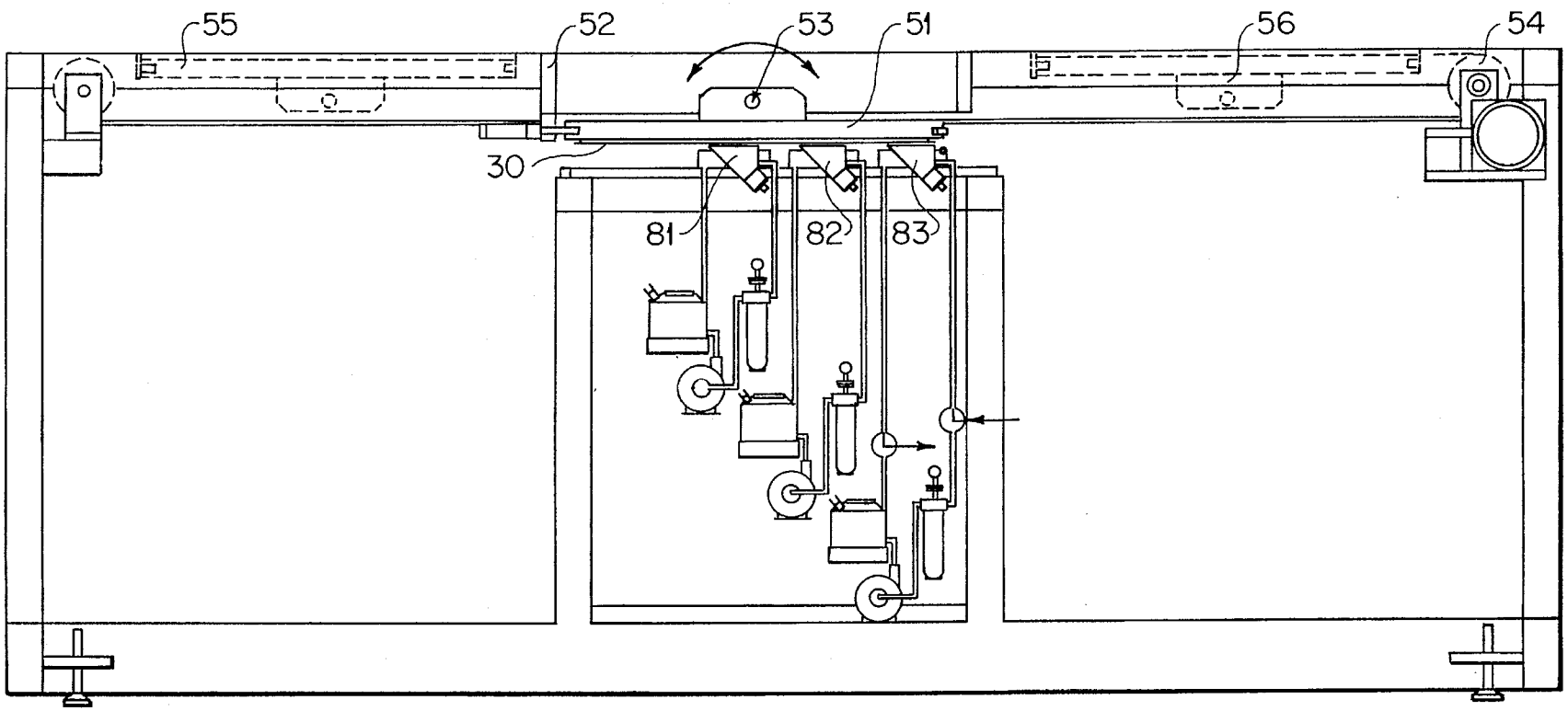
FIG. 7 is a front elevation of a cleaning process module, according to the present invention.
Figure 8:
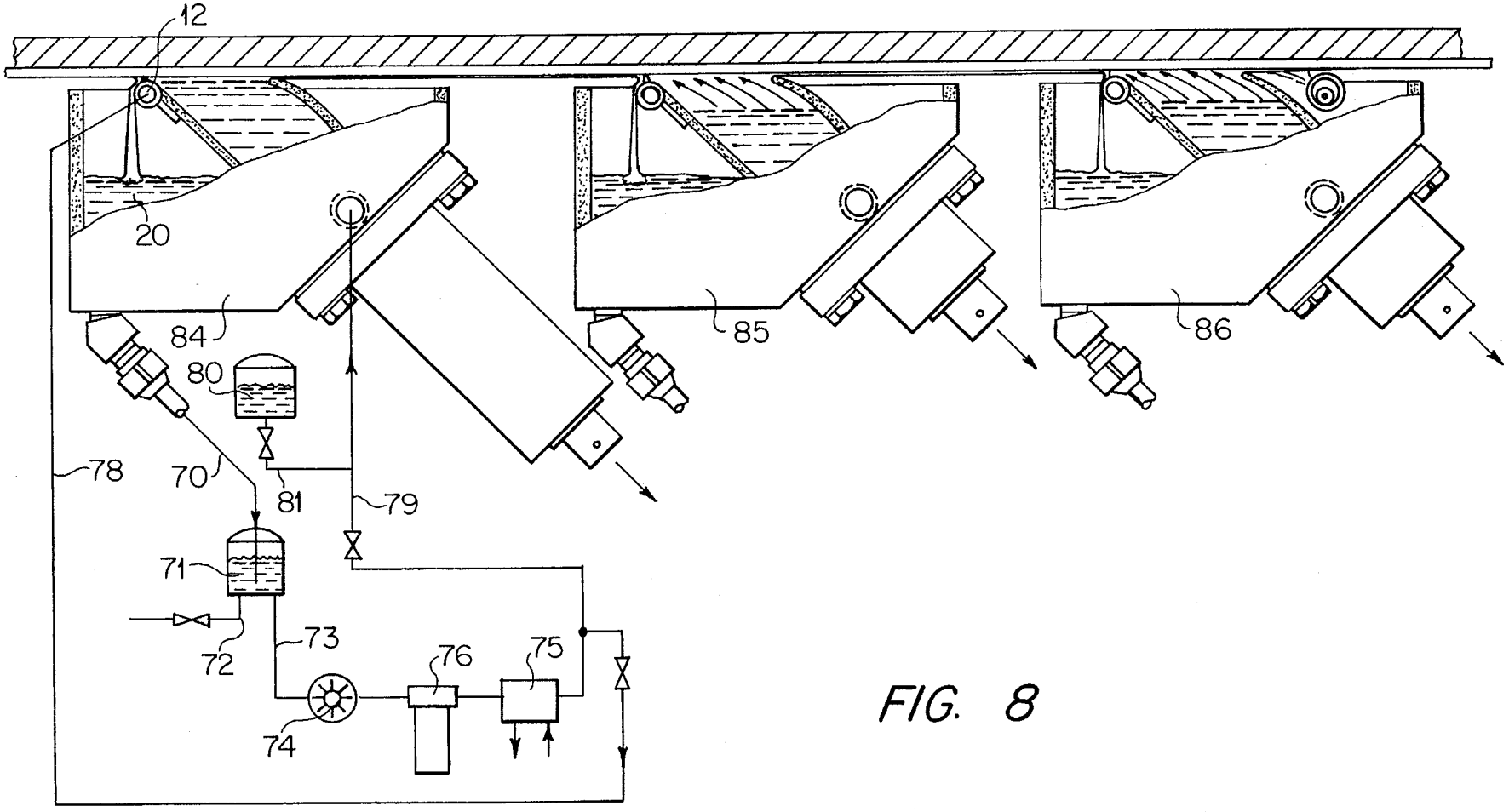
FIG. 8 is a fragmentary vertical schematic view of an installation embodying aligned modules for cleaning, rinsing and drying sequentially and virtually simultaneously in accordance with the present invention.

FIGS. 7, 8 and 12 illustrate an apparatus suitable for practicing the present invention. FIG. 7 is a front view, (FIG. 12 is a top plan), FIG. 8 is an an expanded front view of an apparatus wherein the integrated cleaning, rinsing and drying processes occur simultaneously, and as shown in FIG. 7, the suggested apparatus contains two chemical modules 81, 82 and a D. I. water rinse module 83. The unit as shown accepts flat surfaces, for example, substrates, at the load station and subsequently inverts, cleans, rinses and dries the surfaces in a continuous processing manner. Several means of automatically feeding flat surfaces to and from the machine are readily available. For example, as noted in FIG. 12, cassette fixture 41 may be used for loading and unloading the flat surfaces to and from the processing unit. The various processing functions of the unit which include liquid circulation, temperature control, surface travel speed, etc. are controlled from console 45 shown in FIG. 12 view.

FIG. 8 is an expanded and fragmentary front elevation of the processing unit shown in FIG. 7 wherein cleaning, rinsing and drying occur simultaneously. A vacuum chuck 51 which rotates 180° within transport frame 52 mounted upon two rotating bearings 53. One of the bearings 53 contains a rotating seal to allow vacuum to be maintained within the vacuum chuck assembly in order to support the surface 30 of the object to be cleaned in an inverted position. Such a flat panel active surface 30 is positioned about 4–6 mm above the upper edges of the cleaning modules 81, 82 and rinsing module 83. A double chain arrangement and sprockets 54 are used to index the vacuum chuck 51 from the load area 55 to the unload area 56. The panel surface 30 is scanned across the modules by a conventional speed-controlled motor drive (not shown). After performing the cleaning, rinsing and drying function, the panel is unloaded in a manner which is the reverse of the loading process. If desired, the apparatus may be designed alternatively to maintain the flat surface 30 in an inverted stationary position while the cleaning, rinsing and drying processing modules are moved across the surface.

FIG. 8 details a view of the three modular units shown in FIGS. 7 and 12. As noted in FIG. 8, two modular units 84, 85 are dedicated to providing cleaning liquid with the simultaneous application of ultrasonic and megasonic energies to the inverted surface 30 while the third unit 86 is dedicated to rinsing and drying with the inclusion of megasonic energy and surface tension gradient drying processing. The general detail of the fluid recirculation, makeup and drainage components are noted.

Cleaning or rinsing liquid is withdrawn from the second chamber 20 of the cleaning and rinsing modules 86 via line 70 to accumulation tank 71. Excess or contaminated liquid is drained from the accumulator tank 71 or waste liquid storage (not shown) via line 72. Liquid within the accumulator 71 is directed to pump 74 via line 73. The liquid is then passed through heating and cooling element 75 for controlling the temperature level of the cleaning and rinsing liquids. All recirculated liquid is filtered by the particulate filter 76. Particulate filter with at least a 90% retention level of 0.1 micron particulate sizes are preferred to maintain the stringent cleanliness levels required of the cleaning process. Then, liquid is recirculated to the first chamber 10 and aqueous/surface to be cleaned interface via contact tube 12 of the cleaning and rinsing modules via line 79 and tube 78, respectively. Makeup liquid from fluid storage container 80 may be supplied to the first chamber of each of the modules 84, 85 and 86 via line 81 in order to compensate for liquids drained or otherwise consumed in the cleaning and rinsing processes.

EXAMPLE 1

TYPICAL CLEANING PROCESS

The unit illustrated in FIGS. 7 and 8 is capable of processing up to two flat plates per minute with dimensions up to 60 cm×60 cm. This design is capable of accepting a flat glass panel at the load station, inverting, cleaning, rinsing and drying flat panels in a continuous processing manner. Conceptually, this design is readily adaptable to perform in-line contaminant removal for several flat display and semiconductor fabrication activities. Several conventional means of feeding the glass panels to and from the machine are readily available. The machine shown in FIGS. 7 and 8 may be equipped with an indexing mechanism which transports the substrate holding fixture through the following processing positions.

Transport Mechanism:

| Transport Position | Transport Function |
|---|---|
| #1 | Substrate loading |
| #2 | 1st Ultrasonic/liquid cleaning |
| #3 | 2nd Megasonic/liquid cleaning |
| #4 | D.I. water rinsing |
| #5 | Surface tension gradient drying |
| #6 | Substrate unloading |

Total Footprint:

The total footprint of the 7 foot by 3.5 foot processing unit is 22.5 ft.$^2$, including loading, contaminant removal and unloading functions.

Substrate: A glass substrate, 60 cm×0.050 cm, used for Liquid Display Devices.

Processing Speed:

Up to 2 panels per minute.

Cleaning Procedure:

1. As shown in FIG. 7, the glass panel with active surface 30 in a face-up orientation is placed on a vacuum chuck 55 at the Load Position.
2. Vacuum chuck 50 is rotated 180°.
3. Vacuum chuck 50 traverses from left to right at 150 cm per minute.
4. The panel surface 30 is cleaned by:

a. An ultrasonic scrubbing with RCA-1 or a modified RCA-1 cleaning liquid (an aqueous solution of ammonium hydroxide and hydrogen peroxide).

b. A megasonic scrubbing with the RCA-1 or a modified RCA-1 cleaning liquid.

c. A megasonic scrubbing with D. I. rinse water.

d. The directing of an aqueous soluble organic vapor to the deposited rinse water downstream of the trailing edge miniscus to effect surface tension gradient film drying.

5. The glass panel arrives at the unload position.

6. The vacuum chuck rotates 180° in preparation for unloading.

7. The vacuum chuck traverses with relatively high speed to the load position to complete the cleaning cycle.

Consumables:

A prime feature of the cleaning and rinsing processes of the present invention is the relatively low liquid requirements and the proportionately low generation rate of waste liquids. The following analysis provides estimates of fluid consumption.

Assumptions:

No credits taken for liquid recycling.

Plate size: 60 cm×60 cm=3600 $cm^2$.

Plate processing speed: two plates per minute.

System cleaning and rinsing liquid volumes: 6 liters per applicator (includes applicator and recycle tanks, lines, filter, etc.)

Liquid pumping rate: 12 liters per minute or 6 liters per panel.

Based on the above assumptions, fluid usages are as follows:

(Basis: liquid volume consumed per module per 100 $cm^2$ of surface).

Cleaning liquid usage:

6 liters/3600 $cm^2$=0.17 liters/100 $cm^2$.

Rinsing liquid usage:

6 liters/3600 $cm^2$=0.17 liters/100 $cm^2$.

Alcohol liquid usage: (for surface tension gradient drying).

Estimated at 0.004 $cm^3$/100 $cm^2$ (essentially insignificant). The intense and concentrated cleaning and rinsing processes directed to the surface 30 between the leading and trailing edge menisci are key factors in low liquid makeup requirements and also the generation of low liquid waste volumes. If liquid recycling were practiced, the consumable and waste volumes would be further reduced. The liquid usage and waste generation rates are at least one to three orders of magnitude less than comparable immersion batch-type processes providing equivalent cleanliness levels.

The cost effectiveness of the present invention is attributable to:

1. Low cleaning liquid and rinse water requirements.

2. The vigorous cleaning action, concentrating upon the panel surface.

3. The rapid processing speeds, approaching up to 150 cm/minute.

Although the invention has been described with respect to specific aspects, those skilled in the art will recognize that substitution of elements may be employed without departing from the spirit of the attached claims.

We claim:

1. Method of cleaning flat substrates comprising:

a. inverting a flat substrate to be cleaned such that a substrate surface to be cleaned is facing down;

b. moving the flat substrate horizontally in a preselected direction;

c. flowing an inclined stream of cleaning liquid at an acute angle, relative to the inverted substrate and opposite to the preselected movement direction of the substrate;

d. concurrently with flowing of the inclined stream, acoustically vibrating said flowing cleaning liquid parallel to flowing direction of the inclined stream of cleaning liquid;

e. elevating said flowing cleaning liquid at a point adjacent the substrate such that said flowing cleaning liquid contacts the substrate and forms a leading edge meniscus and trailing edge meniscus between said oppositely flowing cleaning liquid and said moving substrate to create a weir effect and clean the substrate;

f. injecting additional cleaning liquid transversely of the substrate into the flowing inclined stream of cleaning liquid, at a point which is adjacent the leading edge meniscus thereof and the substrate to be cleaned, so as to lift the inclined stream of cleaning liquid and to create an enhanced weir effect, while simultaneously discharging all of said flowing cleaning liquid downwardly and away from said moving substrate.

2. Method of cleaning flat substrates as in claim 1, wherein said accoustically vibrating is by means of ultrasound vibrations introduced to said flowing cleaning fluid at a frequency of from 20 KHz to 80 KHz, as an aid in solubilizing of surface contaminants and removing particulate materials greater than 1 micron.

3. Method of cleaning flat substrates as in claim 1, wherein said accoustically vibrating is by means of megasonic vibrations introduced to said flowing cleaning fluid at a frequency of from 600 KHz to 6 MHz, as an aid in solubilizing of surface contaminants and removing particulate materials of less than 1 micron.

4. Method of cleaning flat substrates as in claim 3, wherein the substrate surface to be cleaned is exposed to said flowing cleaning fluid accoustically vibrated by ultrasonic vibrations, followed by said megasonic vibrations.

5. Method of cleaning flat substrates as in claim 1, further including flowing aqueous rinsing liquid upwardly and at an inclined acute angle against said moving substrate while acoustically vibrating said flowing aqueous rinsing liquid and elevating said flowing aqueous rinsing liquid at a point adjacent to the substrate such that said flowing aqueous rinsing liquid contacts the substrate and forms a leading edge meniscus and trailing edge meniscus between said flowing rinsing liquid and said moving substrate.

6. Method of cleaning flat substrates as in claim 5, including flowing water soluble organic vapor into said flowing aqueous rinsing liquid down stream of the trailing edge meniscus formed between said flowing rinsing liquid and said moving substrate, such that absorption of the water soluble vapor within said aqueous rinsing liquid effects a liquid surface tension gradient, enhancing draining of adhering aqueous rinsing liquid from the substrate surface into said flowing aqueous rinsing liquid thereby facilitating drying of the substrate surface.

7. Method of cleaning flat substrates as in claim 6, wherein said flowing aqueous rinsing liquid is recirculated.

8. Method of cleaning flat substrates as in claim 7, including filtering of said flowing aqueous rinsing liquid, so as to remove particulate materials.

9. Method of cleaning flat substrates as in claim 7, including heating said flowing cleaning liquid at temperatures less than the cleaning fluid boiling point, thereby heating the substrate surface to be cleaned and contributing to increased solublization of contaminants and enhancing drying.

* * * * *